United States Patent [19]

Olivier

[11] 4,411,759

[45] Oct. 25, 1983

[54] ELECTROLYTIC CHLORINE GENERATOR

[76] Inventor: Paul D. Olivier, 4851 E. Fanfol Dr., Scottsdale, Ariz. 85253

[21] Appl. No.: 345,566

[22] Filed: Feb. 4, 1982

[51] Int. Cl.[3] ..... C25B 9/00; C25B 11/03; C25B 11/04; C25B 13/04

[52] U.S. Cl. ..... 204/260; 204/128; 204/263; 204/266; 204/282; 204/283; 204/291; 204/293; 204/295

[58] Field of Search ..... 204/260, 263–266, 204/282–284, 128, 295, 24, 195 S, 291–294

[56] References Cited

U.S. PATENT DOCUMENTS

| | | | |
|---|---|---|---|
| 1,012,808 | 12/1911 | Bull . | |
| 1,080,826 | 12/1913 | Gibson . | |
| 1,277,378 | 9/1918 | Case . | |
| 2,163,793 | 6/1939 | Logan | 204/9 |
| 2,228,264 | 1/1941 | Freedley | 204/266 |
| 2,363,386 | 11/1944 | Bock | 204/72 |
| 2,427,433 | 9/1947 | Winslow et al. | 204/74 |
| 3,102,085 | 8/1963 | Edwards et al. | 204/128 |
| 3,351,542 | 11/1967 | Oldershaw et al. | 204/149 |
| 3,458,414 | 7/1969 | Crane et al. | 204/149 |
| 3,563,879 | 2/1971 | Richards et al. | 204/272 |
| 3,711,336 | 1/1973 | Smatko | 204/295 X |
| 3,719,531 | 3/1973 | Dzieciuch et al. | 240/295 |
| 3,736,322 | 5/1973 | Helber et al. | 204/266 |
| 3,801,488 | 4/1974 | Okuhara et al. | 204/252 |
| 4,119,503 | 10/1978 | Spaziante et al. | 204/295 X |
| 4,219,400 | 8/1980 | Treptow et al. | 204/283 X |
| 4,248,715 | 2/1981 | Olivier | 204/260 |
| 4,290,873 | 9/1981 | Weaver | 204/228 |

FOREIGN PATENT DOCUMENTS 615619 7/1935 Fed. Rep. of Germany .

*Primary Examiner*—Donald R. Valentine
*Attorney, Agent, or Firm*—Warren F. B. Lindsley

[57] ABSTRACT

An electrolytic chlorine generator employing a porous ceramic diaphragm for the separation of the caustic soda solution from the weakly acidic brine solution and employing as the cathode a flame or plasma deposited porous metallic coating on the outer surface of the ceramic diaphragm.

11 Claims, 5 Drawing Figures

10
11
12
13
14
15
16
17
18
19
21
22
23
24
25
26
27
28
31
32
36
37
38
40
41
42
43
44
49
52
53
54
55
62
67
68
72
82
92
93
95
96
97
98
99
100
101
102
103
104
105
106
107
108
110
111B
112
113
116
118
119
120
121
122
2
4

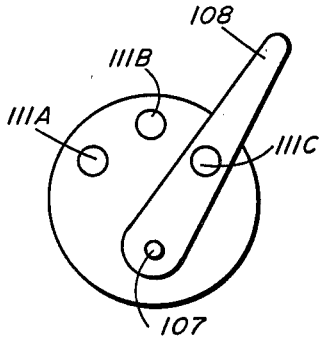
FIG. 1A
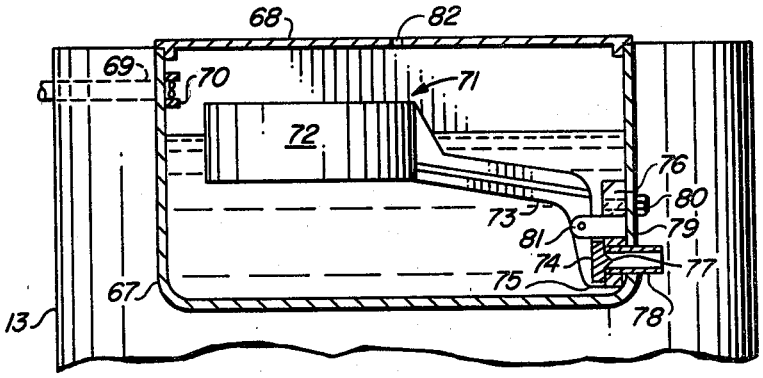
FIG. 2
FIG. 4
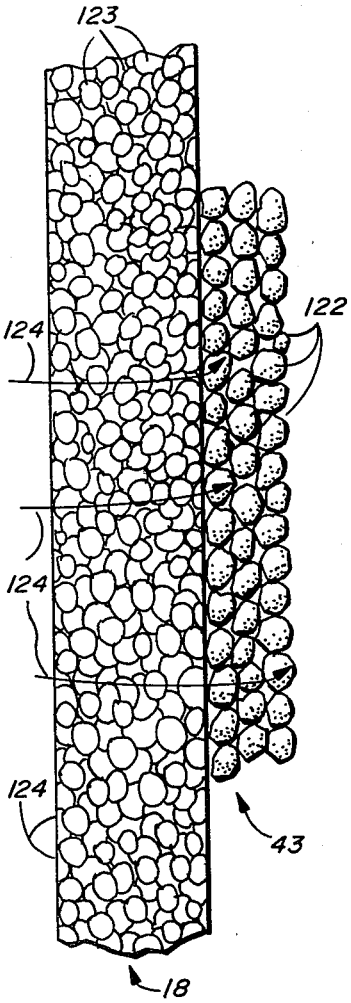
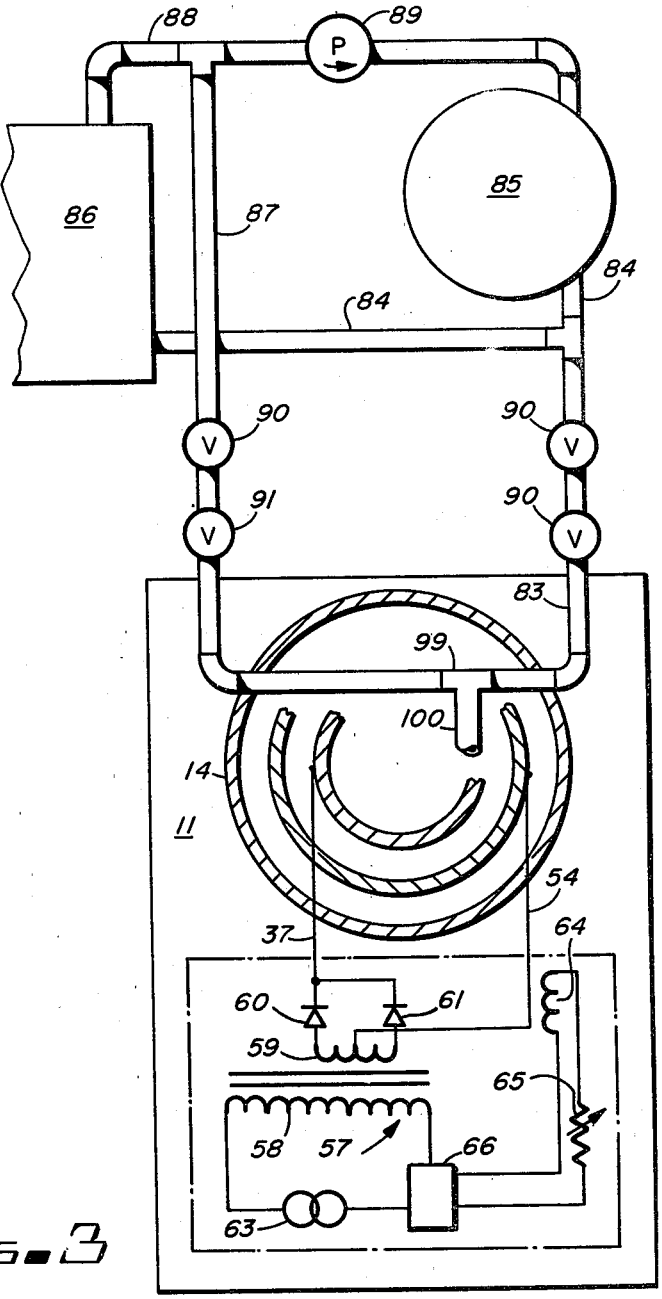
FIG. 3

ELECTROLYTIC CHLORINE GENERATOR

BACKGROUND OF THE INVENTION

The maintenance of a private swimming pool, especially in regard to the chemistry involved, is a complex, time-consuming and expensive routine when handled in the conventional manner.

During the warmer season in particular, the water must be checked almost daily to determine the pH level and chlorine content. Unless these factors are carefully controlled, the growth of bacteria and algae in the pool will be excessive with the result that a hazard to health is produced. In addition, the water and the surfaces of the pool become discolored and unsightly. To maintain the required pH level, frequent addition of acid is required. The chlorine is added chemically, typically in the form of sodium hypochlorite. Because the chlorine is usually added intermittently by this method, a compromise must be accepted in terms of the instantaneous chlorine level with an undesirably high level experienced after the chlorine is added and an undesirably low level existing just prior to the addition. In the interest of producing a leveling effect, certain stabilizing chemicals are added which delay the release of the chlorine, hopefully with an economy realized because of the increased total effectiveness of the chlorine added. The stabilizer can build up excessively, producing a condition known as "chlorine lock", in which the chlorine is tied up and not available as an oxidizing agent. This and other conditions require special corrective procedures. In addition, "shock treatments" involving super-chlorination are required periodically to destroy certain types of algae which develop resistance to the relatively constant lower level of chlorination. Algaecide inhibitors are also recommended along with the "shock treatments".

The foregoing routines are expensive and time-consuming and they tend to bewilder the average pool owner. If he fails to follow the proper procedures faithfully, corrective measures must be taken which are even more expensive in the long run because of the resulting deterioration of the pool itself.

In addition to the foregoing disadvantages of the conventional chlorination procedures employed by the typical home pool owner, the special chemicals added over and above the chlorine itself produce undesirable effects on the pool walls and on clothing, and they are irritating to the skin, eyes and sinuses of those using the pool.

It is recognized that a more desirable result in terms of pool chemistry may be realized if chlorine is introduced as a gas directly into the water rather than in combination with other chemicals. This method is utilized by professional pool maintenance operators, especially in connection with the treatment of the larger public pools. Because of the hazards involved in the handling of the pressurized tanks of chlorine gas and because of the toxicity of the gas, however, this method has not been widely applied in the case of the smaller private pools.

In recent years, small chlorine generators have become available that are intended for operation adjacent to the private swimming pool. These small generators supply a continuous supply of chlorine to the pool with the intended purpose of holding the clorine content as near as possible to the optimum level.

This invention relates to electrolytic chlorine generators of the above mentioned type and, more particularly, to an improved version incorporating a porous ceramic diaphragm in combination with a flame or plasma deposited cathode.

DESCRIPTION OF THE PRIOR ART

Chlorine generation systems suitable for use in treatment of private pools are available commercially, one of which is described in U.S. Pat. No. 3,458,414, but the initial and operating costs of such systems have been excessive.

U.S. Pat. No. 2,228,264 discloses an electrolytic cell adapted to produce chlorine, a salt saline sodium hydroxide solution and hydrogen from a solution of sodium chloride.

U.S. Pat. No. 3,351,542 discloses an electrolytic chlorination and pH control for swimming pool water wherein both chlorine and hydrochloric acid are introduced into the swimming pool water at a predetermined rate.

U.S. Pat. No. 3,563,879 discloses an electrolytic chlorine generator which utilizes the pressure of the chlorine generated for discharging chlorine gas into a water line of a swimming pool.

U.S. Pat. No. 4,284,715 discloses an electrolytic chlorine generator employing a porous ceramic diaphragm for separating strong caustic solutions existing on one side of a cylindrical diaphragm from weak acidic solutions on the other side thereof without deterioration. The anode and the cathode are rings placed concentrically with and in close proximity to the diaphragm.

SUMMARY OF THE INVENTION

The porous ceramic diaphragm for use in electrolytic generators must be chemically resistant to its environment and possess permeability characteristics with very small pores. Mechanical strength is of secondary consideration.

Porous ceramics of various types have been used for many years as filters; however, electrolytic processes require much smaller pores than are desirable for filters in other processes.

Chemical inertness in electrolytic chlorine generators is of prime importance since strong caustic solutions exist on one side of the diaphragm and weak acidic solutions exist on the other side of the diaphragm.

While these demands are effectively met in the apparatus of U.S. Pat. No. 4,248,715 through the provision of a suitable ceramic material and structure for the diaphragm, further improvements in the cathode structure of the described apparatus can provide significant operating advantages.

The geometric configuration of the anode and cathode structures plays an important part in the overall performance of the system, as well as the distance between the anode and the cathode. Tests have shown that for batch processed cells, those in which a fixed quantity of salt and water are contained until the electrolytic process is completed, a configuration in which the diaphragm is a cylinder and the anode and cathode are rings placed concentrically with the diaphragm in close proximity to it is desirable.

In accordance with the invention claimed, an improved electrolytic chlorine generator is provided for commercial and home use. The improved generator utilizes a porous ceramic diaphragm or basket for separating a sodium hydroxide solution from the resulting acidic solution during and after the generation of chlorine gas from this solution and employs as a cathode a flame or plasma deposited porous metallic coating applied directly to the outside surface of the ceramic diaphragm.

It is, therefore, one object of this invention to provide a new and improved electrolytic chlorine generator.

Another object of this invention is to provide an improved electrolytic chlorine generator having a porous ceramic diaphragm and an improved cathode structure.

A further object of this invention is to provide an improved diaphragm and cathode structure for use in chlorine generators of this type and for possible application in other types of electrolytic cells.

A further object of this invention is to provide such a diaphragm and cathode structure in a form which permits a significant reduction in the separation between the anode and cathode and thereby permits improved operating efficiency A further object of this invention is to provide a cathode for such a structure in a form which effectively increases the working surface area of the cathode and thereby permits the realization of the desired ratio of the cathode surface area to the anode surface area without increasing the effective separation of these electrodes or compromising anode, cathode spacing for geometric considerations.

A still further object of this invention is to provide a deposited cathode structure of a given porosity, yet not barring ionic flow or acting as a second diaphragm.

A still further object of this invention is to provide an improved diaphragm and cathode structure which results in a reduction in overall mechanical complexity and assembly cost for the total structure of the electrolytic generator.

Further objects and advantages of the invention will become apparent as the following description proceeds, and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which:

FIG. 1A is a front view of the selection valve shown in FIG. 1;

FIG. 2 is a side view partly in section of the chlorine generator shown in FIG. 1;

FIG. 3 is a diagrammatic representation of the invention as connected with a filtrating system of a swimming pool; and FIG. 4 is an enlarged cross-sectional view of the circled area 4 of FIG. 1 showing the ceramic cup material with flame-deposited cathode material on the outside surface of the cup.

DESCRIPTION OF THE PREFERRED EMBODIMENT

Figure 1:
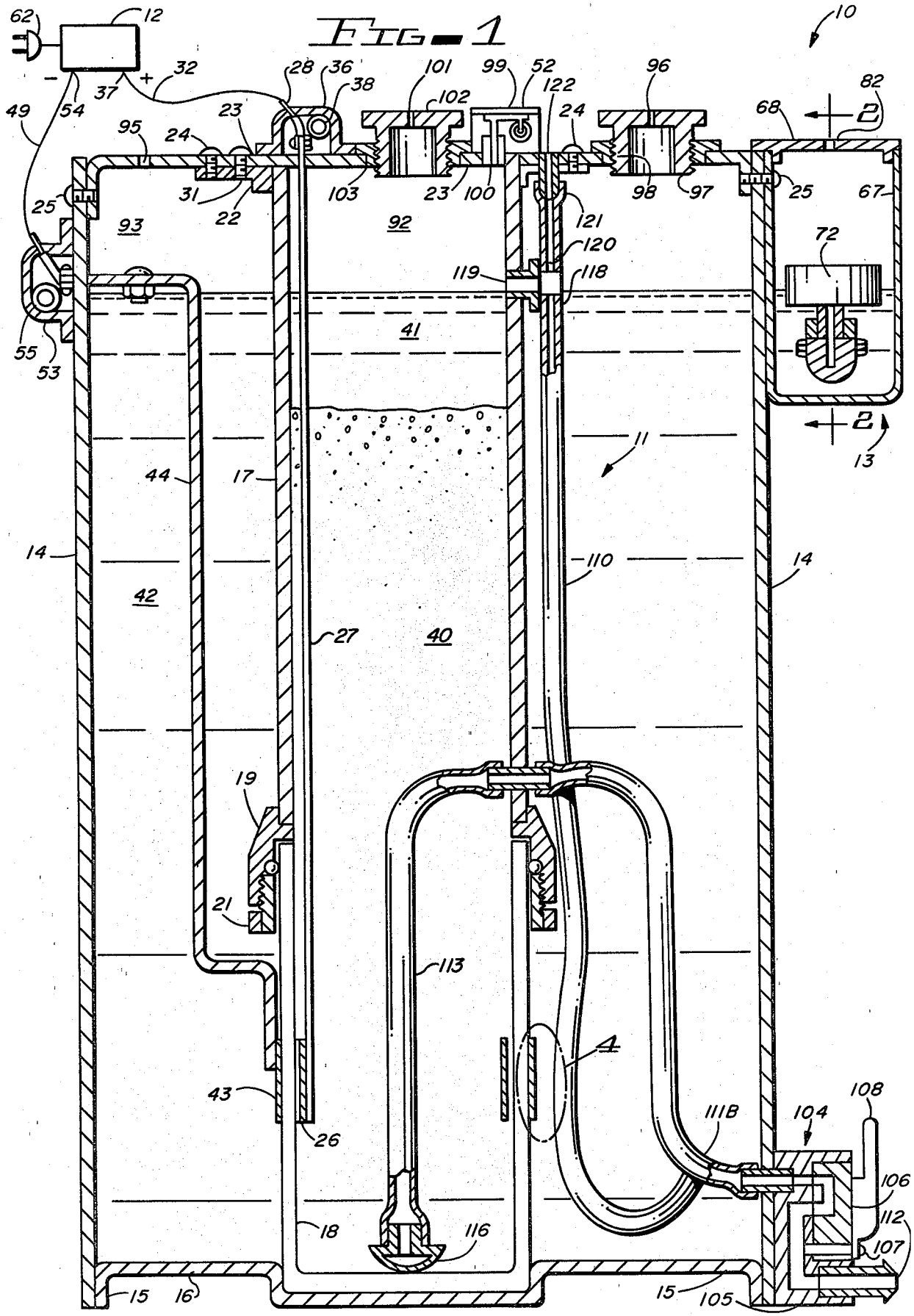
FIG. 1 is a diagrammatic illustration of a chlorine generator employing a ceramic cylinder as the diaphragm and a material flame or plasma deposited on the cylinder as the cathode and embodying the invention.

Referring more particularly to the drawings by characters of reference, FIGS. 1 and 2 disclose an improved chlorination system 10 especially devised for use in the purification of swimming pools, the system comprising an electrolytic chlorine generator 11 with its associated power supply 12 and mixing chamber 13.

The chlorine generator 11 is modeled after the Hooker diaphragm cell, the principles of which are well-known in the art, with the construction of generator 11 modified to meet the particular needs of this invention. Generator 11 comprises an upright cylindrical outer wall 14 having its lower end cemented to a vertical flange 15 of a horizontal base plate 16. An upright cylindrical inner wall 17 arranged concentrically with outer wall 14 has a diameter approximately one-third that of outer wall 14 and is connected to a porous ceramic cylindrical cup 18 by a flange 19. The pores of cup 18 may have a volumetric porosity of between 25 and 60 percent and an average pore size of 0.5 microns, and its diameter is approximately the same diameter as inner wall 17. Flange 19 seals cup 18 to wall 17 by means of an O-ring 20 and packing nut 21. Cylindrical cup 18 fits inside a recess in base plate 16 for lateral support. Flange 22 cemented to the upper end of cylinder 17 provides a means of attachment to a horizontal cover plate 23 by screws 24. Cover plate 23 is fitted inside outer wall 14 and supported atop inner wall 17, which is slightly shorter than outer wall 14, by screws 25.

A cylindrically coated, expanded, metallic, ring-shaped anode 26 is concentrically centered within and in close proximity to porous cylindrical ring or cup 18 and supported by conductor strap 27 to which it is secured by welding. Conductor strap 27 passes through a slot in cover plate 23 and is suitably connected to an electrical conductor 32. Conductor 32 passes through a hole in terminal cover 36 and is connected to positive terminal 37 of power supply 12. A conduit 38 for cooling water also passes through cover 36. The terminal connection of electrical conductor 32 and cooling conduit 38 are encapsulated in epoxy within cover 36 and cemented to cover plate 23. A quantity of rock salt 40 is contained within inner wall 17 with a quantity of water making a salt brine 41 which may have some dissolved chlorine. Caustic soda 42 is contained between inner and outer walls 17 and 14, respectively.

A flame or plasma deposited porous metallic cathode 43 is applied directly to the outside surface of the porous ceramic cup 18 in the form of a thin cylindrical ring that is concentric with the cylindrical wall of cup 18 and with ring-shaped anode 26. Conductor strap 44, which is soldered, brazed, welded or mechanically attached to cathode 43, passes through a slot in outer wall 14 for connection to electrical conductor 49. Conductor 49 passes through a hole in terminal cover 53 and is connected to negative terminal 54 of power supply 12. A conduit 55 for cooling water passes through cover 53 with the terminal connection and cooling conduit 55 being encapsulated in epoxy within cover 53. Cover 53 is cemented to outer wall 14.

Power supply 12, as illustrated in FIGS. 1 and 3, comprises a step-down transformer 57 having a primary winding 58 and a center-tapped secondary winding 59, rectifier diodes 60 and 61, input power cord 62 and output electrodes 37 and 54. The diodes 60 and 61 have their cathodes connected to positive electrode 37. The anode of diode 60 is connected to one end of secondary winding 59 and the anode of diode 61 is connected to the other end of winding 59. The centertap of winding 59 is connected to negative electrode 54. When the primary winding 58 is connected to a source of alternating current voltage 63 by means of cord 62, a positive output voltage is developed at electrode 37 relative to electrode 54.

Current coil 64 produces a voltage proportional to the output current. This voltage is modulated by variable resistor 65 and fed into voltage regulator 66.

The mixing chamber 13 shown in more detail in FIG. 2 comprises an upright, cylindrical, plastic container 67 covered by a plastic lid 68 secured in place by a close fit. An inlet tube 69 penetrates the vertical wall of container 67 and is secured therein by means of a retainer 70. Outlet flow from mixing chamber 13 is controlled by float valve assembly 71, comprising float 72 and an inclined pivot arm 73, with rubber valve plug 74 secured to pivot arm 73 by retainer 75, which is cemented to pivot arm 73. Valve body 76 provides the base for mounting and the valve seat 77 in the outlet pipe 78. Valve assembly 71 is attached to the vertical wall of chamber 67 against gasket 79 by bolt 80.

Pivot arm 73 is pivotally attached to the top of valve body 76 by means of a pivot pin 81. When float 72 is not buoyed upwardly by water, its weight tilts lever 73 downwardly, causing plug 74 to pivot in a counter clockwise direction about pin 81 and causing plug 74 to bear against the valve seat in pipe 78 to block the flow of water thereinto. Rising water inside container 67 lifts float 72 and moves plug 74 away from valve seat 77, thus permitting the exhausting of water through outlet pipe 78 and thereby regulating the level of contained water. Vent hole 82 in cover 68 allows any entrained air to escape.

As shown in FIG. 3, water from the swimming pool passing through the filter system plumbing, including pipe 88, filter 85 and pipe 84, enters inlet pipe 83 of generator 11 through a tap in filter outlet pipe 84, which pipe carries the water from filter 85 back to pool 86. Water passing through generator 11 returns through outlet pipe 87 back into filter inlet pipe 88, filter 85 and back into the pool through pipe 84. The pool filter pump 89, which is connected into pipe 88, circulates pool water through filter 85 and thereby creates a pressure differential between filter inlet and outlet pipes 84 and 88. The pressure differential thus created includes a desired flow of pool water through generator 11 via pipes 83 and 87, the gate valves 90 permitting isolation of the chlorination system for maintenance and repair and the check valves 91 preventing reverse water flow under abnormal conditions.

The operation of the total chlorination system 10 occurs as follows:

Electrical current flowing from positive electrode 37 of power supply 12 passes through conductor 32 and strap 27 to anode 26, from anode 26 through brine solution 41, through the pores in the wall of cup 18 to cathode 43 and thence through conductors 44 and 49 to negative electrode 54 of supply 12. The current passing from anode 26 to cathode 43 produces an electrolytic reaction in the brine solution 41 which involves the production of chlorine gas 92 at the anode 26 and the simultaneous collection of hydrogen and sodium hydroxide (caustic soda) at the cathode 43. The ceramic inner wall of cup 18 separates and isolates the chlorine from the hydrogen and the salt brine from the sodium hydroxide to prevent recombination. The brine solution 41 is maintained at a saturated level by a charge of sodium chloride 40 contained within wall 17 and surrounding anode 26.

The hydrogen gas 93 generated at the cathode 43 rises to the surface of the caustic soda 42 and is discharged to the atmosphere through vent hole 95 in cover plate 23 and through vent hole 96 in fill cap 97. Fill cap 97 is screwed into bushing 98 which is cemented to cover 23.

The chlorine gas generated at anode 26 rises to the surface of brine 41 and is drawn into syphon pump 99 through pipe 100 by venturi effect where it is mixed with water and is carried through tube 69 into mixing chamber 13 where further mixing occurs due to turbulence inside container 67. The water also passes through conduit 38 in cap 36 and conduit 55 in cap 53, providing cooling for the terminals respectively therein. The chlorinated water then leaves container 67 via outlet pipe 78 and is carried by pipe 87 to pump 89 and thence to the swimming pool. Ideally, the pump 89 operates continuously and a continuous and constant supply of free chlorine is thus delivered to the pool. The rate of chlorine generated and delivered to the pool may be controlled by any of a number of means, including control of the voltage supplied by power supply 12 or by cycling power supply 12 on and off at an adjustable duty cycle. A means for adjusting the power supply voltage is suggested by the illustration of the current coil 64 and variable resistor 65 with voltage regulator 65 controlling the primary winding 58 of transformer 57. Corresponding to each given current, a given rate of chlorine generation will be produced.

A vent 101 in the center of fill cap 102, which is screwed into bushing 103 and cemented into cover 23 of generator 11, and a vent 82 in the top of a container 67 enhance the venturi action involved in the transfer of chlorine gas through tube 100 by relieving the vacuum developed over brine solution 41 and the pressure head developed over the chlorinated water in container 67.

In normal operation, the only maintenance required is the emptying of the generator periodically and the addition of a new supply of salt and water. This is accomplished by manipulation of valve 104, which is comprised of valve body 105, a rotatable selector segment 106 which pivots about pin 107 by a handle 108. Also, a part of the valve 104 comprises a multitude of inlet ports 111A–111C, one for each selectable port and an outlet pipe 112.

One of the three selectable ports is connected through one of the three inlet pipes 111A (not shown) through the wall of chamber 14 and to the space between chamber 14 and inner wall 17 for draining of the sodium hydroxide solution 42. A second inlet pipe 111B is connected through wall 17 and pipe 113 to strainer 116. This port is for draining off the brine solution. A third inlet pipe 111C (not shown) is connected to tube 110 and in turn through tee 118 to pipe 119 which penetrates and is cemented to wall 17. Tube 120 and pipe 121 provide vent 112 for this overflow drain.

Water may move through the mixing chamber 13 at a rate sufficiently high to produce a relatively low chlorine content in the circulated water, thereby preventing the gas from attacking the metal parts of the pump 89.

As shown in the drawings, the walls 18 forming the salt holding diaphragm or basket comprise a porous ceramic material having a predetermined pore size and porosity for the electrolytic process disclosed, but much smaller than the pore sizes required for filters in other processes.

Microscopic examination of pure sintered alumina after treatment with hot sodium hydroxide solutions shows that grain boundaries thereof are attacked by the solutions, leaving thin grooves between the pores.

These data show that the grain boundaries are somewhat lower in chemical resistance than are the crystallites themselves. This phenomenon is somewhat a mystery since for pure alumina no "glass-phase" or binder is present. This may be attributed to the fact that during sintering most impurities move to the grain boundaries, thus leaving the crystals more pure than the boundaries. In general, contaminations are more susceptible to chemical attack than the pure dense alumina itself. A second reason for this phenomenon may be that the layers do not entirely belong to the two neighboring grains, but in some way to both of them and are therefore subject to internal stresses. Accordingly, it must be more susceptible to any kind of external attack than the inner part of the grain itself.

In any event, the fact remains that the external attack is present mostly at the boundaries, leaving grooves of a size smaller than the grains. Until the attack has proceeded to loosen a grain completely from all surrounding grains, this attack only serves to slightly increase porosity, which for this application is not an undesirable property.

It should be noted that the chemical environment of the barrier between the cathode and the anode in a chlorine cell has on the cathode side a warm sodium hydroxide solution of 1.0–14 percent concentration which has the potential of attacking the grain boundaries. On the anode side, a saline solution exists containing a gaseous chlorine and dissolved chlorine and some hydroxide ions in a weak acidic solution to which alumina is known to be inert. Thus, the catholite surface is the only one in contact with the known etchent.

Because of its relative availability and projected inertness to the environment of a batch processed cell at low temperatures, alumina is the most desirable material for use as a diaphragm in an electrolytic chlorine generating system. If the purity of the alumina is kept as high as possible to reduce the grain boundary attack by the sodium hydroxide solution, 99.7–99.8 percent, alumina is the best product known for the diaphragm use. Silica is the most common impurity in commercially available alumina and is most readily attached by sodim hydroxide. It is obvious, therefore, that the lowest amount of silica possible in the ceramic material is desired. The most desirable chemical composition of the alumina disclosed for use in the chlorine generator described is 99.7% $Al_2O_3$; 0.1% MgO; 0.1% $Na_2O$; and traces of $SiO_2$ and CaO.

Alternate materials suggested for use in the ceramic diaphragm, information regarding the ceramic microstructure, related processing and manufacturing procedures are described in U.S. Pat. No. 4,248,715 and are incorporated herein by reference. While the characteristics of the ceramic material and the related processes are significant relative to the proper operation of the present invention, the salient contribution disclosed herein is concerned with the nature of the deposited cathode and with the desirable characteristics afforded by the combined diaphragm and cathode structure.

It is recognized by those skilled in the art that for optimum efficiency of the electrolytic generator, the separation between the anode and the cathode should be minimized; and the effective working surface area of the cathode should have a definite area relationship to that of the anode dependent on the configuration of the anode and cathode and the materials used.

The present invention achieves a significant improvement in terms of both of these requirements through the use of the flame or plasma deposited cathode. As represented in FIG. 4, the granular structure of the deposited cathode 43 comprises relatively large grains 122 as compared with the smaller grains 123 of the ceramic diaphragm 18. The open grain structure of the cathode is important for two reasons. First, it permits free ionic current flow 124 between the grains 122, thereby preventing the cathode grain structure from acting like a diaphragm and permitting free flow of the hydroxide ions to combine with the sodium ions permeating the diaphragm. Secondly, the open grain structure exposes a relatively large cathode surface area as compared with the overall dimensions of the cathode 43. This is in contrast to the case of the separate solid ring cathode in which only the inside surface is effective in terms of working surface area. It is thus possible to employ a cylindrical cathode with smaller overall dimensions than those of a separate cathode while achieving the desired area ratio of cathode-to-anode surface areas which may be, for example, a 4:1 ratio. In accomplishing this relationship, a simultaneous reduction in the effective anode-to-cathode separation is realized because it eliminates the more remote portions of the cathode which would otherwise extend past the boundaries of the anode.

There is also the obvious reduction in anode-to-cathode spacing that is realized by flame or plasma deposition of the cathode directly upon the diaphragm surface as compared with a separate cathode ring that would introduce a clearance distance between the cathode and the diaphragm as the result of dimensional tolerances and considerations essential to assembly operations.

The cathode material may be one of a number of conductive materials including carbon steel, stainless steel or nickel aluminide.

The flame or plasma deposition of metals is a well-known process. In this case, it must be carefully controlled to maintain the desired porosity.

An improved electrolytic gas generator is thus provided for use in the intermediate application as a chlorine generator. The principles are applicable as well to any of a number of other electrolytic cells. In the form described, the novel construction provides improved operating efficiency and other advantages, in accordance with the stated objects of the invention.

Although but a single embodiment of the invention has been illustrated and described, it will be apparent to those skilled in the art that various changes and modifications may be made therein without departing from the spirit of the invention or from the scope of the appended claims.

What is claimed is:

1. An electrolytic cell for the generation of gaseous chlorine comprising:

a cathode chamber, an anode chamber for receiving therein an aqueous solution of a metallic chloride, the walls of said anode chamber separating said cathode chamber from said anode chamber being at least partially formed of a porous ceramic material which extends into both cathode chamber and the anode chamber, an anode mounted in said anode chamber extending into the aqueous solution when it is placed therein, a cathode in said cathode chamber deposited on said ceramic material in said cathode chamber and being in communication with said anode chamber through pores in said ceramic material, said cathode comprising a porous metallic coating deposited on said ceramic material and having a porosity greater than the porosity of said ceramic material, means for supplying a DC voltage across said anode and said cathode to produce gaseous chlorine in said anode chamber; and an outlet in each chamber.

2. The electrolytic cell set forth in claim 1 wherein:

said cathode comprises a flame deposited, porous, metallic coating applied directly to the surface of said ceramic material.

3. The electrolytic cell set forth in claim 1 wherein:

said cathode comprises a plasma deposited, porous, metallic coating applied directly to the surface of said ceramic material.

4. The electrolytic cell set forth in claim 1 wherein:

said cathode comprises a granular metallic material, the grain size of which is greater than the grain size of said ceramic material.

5. The electrolytic cell set forth in claim 1 wherein:

the cathode and anode have any dimensional relationship with the cathode providing approximately four times the exposed surface area as said anode.

6. The electrolytic cell set forth in claim 1 wherein:

said cathode comrises a conductive material of the group comprising carbon steel, stainless steel and nickel aluminide.

7. The electrolytic cell set forth in claim 1 wherein:

said ceramic material comprises a diaphragm of a cylindrical configuration, and said cathode assumes the configuration of said diaphragm.

8. An electrolytic cell comprising:

an anode compartment, a cathode compartment, an anode positioned in said anode compartment, a porous separator defining an area between said compartments, a cathode deposited on the surfaces of said separator within said cathode compartment juxtapositioned to said anode, said cathode comprising a flame and/or plasma deposited porous metallic coating applied directly to the surface of said area of said porous separator material, and an outlet in each compartment.

9. Th electrolytic cell set forth in claim 8 wherein:

said separator has pores from 0.25 to 10 microns in size, and said cathode has a greater pore size.

10. The electrolytic cell set forth in claim 8 wherein:

said separator has a cylindrical configuration.

11. A electrolytic cell for the generation of gaseous chlorine comprising:

a cathode chamber, an anode chamber for receiving therein an aqueous solution of a metallic chloride, the walls of said anode chamber separating said cathode chamber from said anode chamber being at least partially formed of a porous ceramic material which extends into both cathode chamber and the anode chamber, an anode mounted in said anode chamber extending into the aqueous solution when it is placed therein, a cathode in said cathode chamber deposited on said ceramic material in said cathode chamber and being in communication with said anode chamber through pores in said ceramic material, means for supplying a DC voltage across said anode and said cathode to produce gaseous chlorine in said anode chamber; and an outlet in each chamber.

* * * * *